US005220097A

United States Patent [19]

Lam et al.

[11] Patent Number: 5,220,097

[45] Date of Patent: Jun. 15, 1993

[54] FRONT-END HYDROGENATION AND ABSORPTION PROCESS FOR ETHYLENE RECOVERY

[75] Inventors: Wilfred K. Lam, Arcadia, Calif.; Yuv R. Mehra, The Woodlands, Tex.; Don W. Mullins, Glendora, Calif.

[73] Assignees: Advanced Extraction Technologies, Inc., Houston, Tex.; Kinetic Technology International Corp., San Dimas, Calif.

[21] Appl. No.: 836,911

[22] Filed: Feb. 19, 1992

[51] Int. Cl.[5] ..... C07C 7/00; C07C 7/10; C07C 5/03; F25J 3/02

[52] U.S. Cl. ..... 585/809; 585/802; 585/833; 585/259; 62/24; 62/17

[58] Field of Search ..... 585/809, 802, 833, 259; 62/24, 17

[56] References Cited

U.S. PATENT DOCUMENTS

| | | | |
|---|---|---|---|
| 2,938,934 | 5/1960 | Williams | 585/809 |
| 3,691,251 | 9/1972 | Bauer | 260/683 R |
| 4,345,105 | 8/1982 | Rogers | 585/271 |
| 4,540,422 | 9/1985 | Hampton | 62/21 |
| 4,743,282 | 5/1988 | Mehra | 55/68 |
| 4,832,718 | 5/1989 | Mehra | 55/68 |
| 4,883,515 | 11/1989 | Mehra et al. | 62/17 |
| 5,019,143 | 5/1991 | Mehrta | 62/20 |

OTHER PUBLICATIONS

"Ethylene Plant Fractionation", by G. M. Clancy and R. W. Townsend, *Chemical Engineering Progress*, vol. 67, No. 2, pp. 41–44, (Feb. 1971).

"Catalyst Aids Selective Hydrogenation of Acetylene", by W. K. Lam and L. Lloyd, *The Oil and Gas Journal*, Mar. 27, 1972, pp. 66–70.

"Low-Capital Ethylene Plants", by W. K. Lam and A. J. Weisenfelder, presented by the AIChE Spring National Meeting, Apr. 6–10, 1986 in New Orleans, La., pp. 1–7.

"The Mehra Process SM Technology—An Alternative Approach to Ethylene Recovery", by Yuv R. Mehra, presented at 1988 DeWitt Petrochemical Review, Mar. 23–25, 1988, pp. 1–12.

"Theory and Reaction Mechanism for Commercial Selective Catalytic Hydrogenation Reactors", by W. K. Lam, presented at the Petrochemicals Session at PACHEC 1988, Oct. 19–21, 1988, pp. 1–8.

"Benefits of Acetylene Reactor Modeling", by W. K. Lam, S. C. K. Cua, and K. F. McNulty, AIChE Ethylene Producers' Conference, Mar. 19, 1990, pp. 1–10.

"An Improved Ethylene Process", by W. K. Lam, Y. R. Mehra, and D. W. Mullins, presented at the KTI Symposium 1991, Oct. 3, 1991, pp. 1–16.

"KTI/AET offer cracker design for the future", *European Chemical News*, Oct. 14, 1991, p. 1.

*Primary Examiner*—Anthony McFarlane
*Assistant Examiner*—Nhat Phan
*Attorney, Agent, or Firm*—Depaoli & O'Brien

[57] ABSTRACT

A continuous process is described for contacting an olefins-containing feed gas stream, freed of $CO_2$ and sulfur compounds, in a front-end heat-pumped depropanizer to remove the $C_{4+}$ compounds, selectively hydrogenating the overhead stream to significantly reduce the acetylene and diolefins content, dehydrating the reactor effluent to remove traces of moisture, feeding the dehydrated stream to an intercooled and reboiled demethanizing absorber to produce a rich solvent containing ethylene and heavier hydrocarbons, feeding the absorber overhead stream to an auto refrigerated recovery unit to remove hydrogen, methane, and CO as overhead to a fuel gas system, separating the rich solvent in a solvent regenerator into an overhead stream of ethylene and heavier hydrocarbons and a bottom lean solvent stream for recycle to the demethanizing absorber, combining the overhead of the solvent regenerator with the bottoms of the demethanizer in the auto refrigerated recovery unit, and feeding the combined stream to a deethanizer which produces an overhead stream that is split into ethylene as product and ethane for recycling to the cracker.

20 Claims, 1 Drawing Sheet

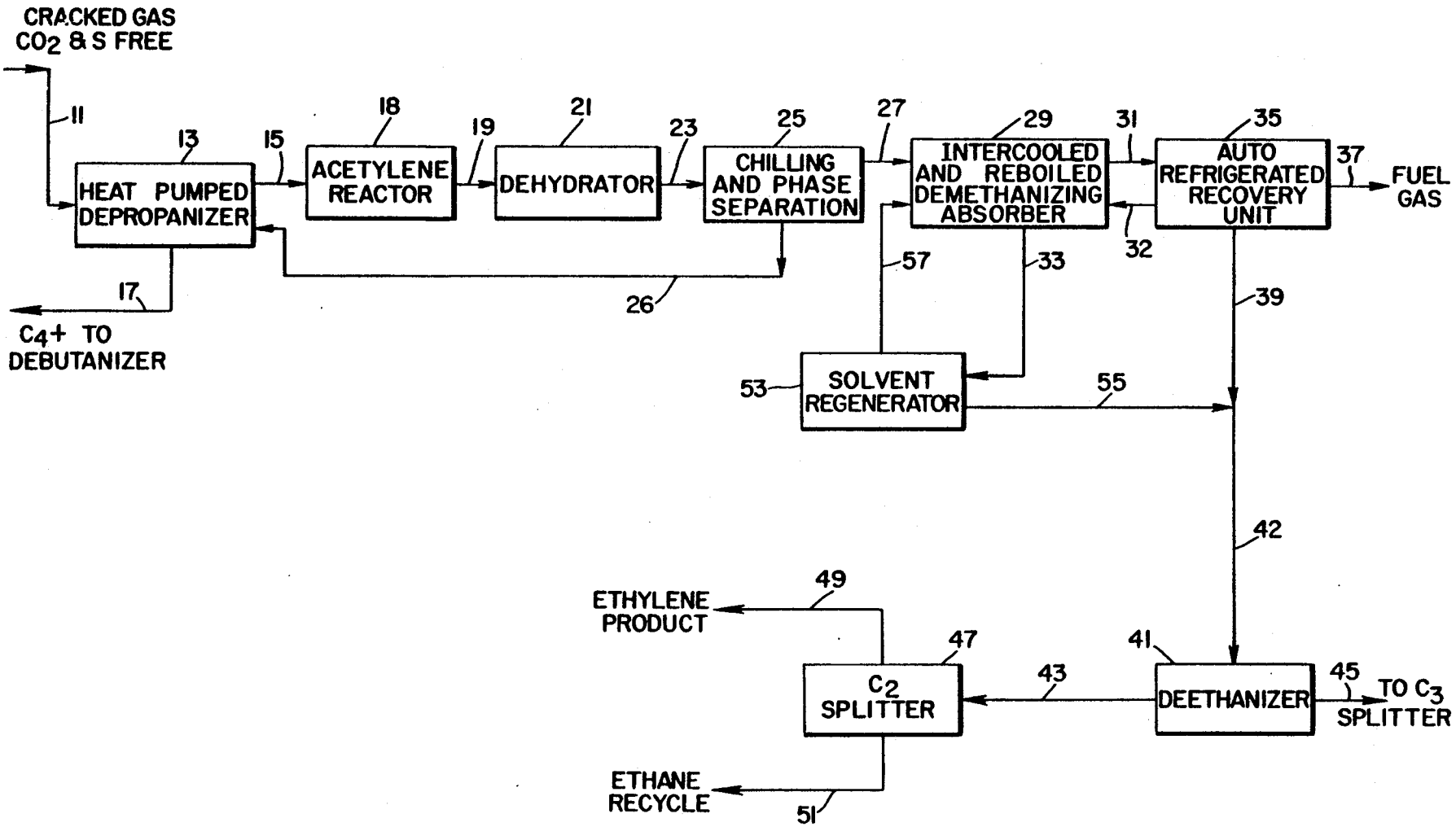
CRACKED GAS
$CO_2$ & S FREE
11
HEAT PUMPED DEPROPANIZER
13
15
ACETYLENE REACTOR
18
19
DEHYDRATOR
21
23
CHILLING AND PHASE SEPARATION
25
26
27
INTERCOOLED AND REBOILED DEMETHANIZING ABSORBER
29
31
32
33
AUTO REFRIGERATED RECOVERY UNIT
35
37
FUEL GAS
$C_4$+ TO DEBUTANIZER
17
39
42
55
57
SOLVENT REGENERATOR
53
DEETHANIZER
41
43
45
TO $C_3$ SPLITTER
$C_2$ SPLITTER
47
49
51
ETHYLENE PRODUCT
ETHANE RECYCLE

FRONT-END HYDROGENATION AND ABSORPTION PROCESS FOR ETHYLENE RECOVERY

BACKGROUND OF THE INVENTION

1. Field of the Invention

This invention relates to recovery of olefins from pyrolyzed hydrocarbon gases and/or refinery off-gases and especially relates to recovery of olefins by absorption with a preferential physical solvent from de-acidified, compressed, and dried hydrocarbon gases containing olefins.

2. Review of the Prior Art

Olefins such as ethylene and propylene are present in thermally or catalytically cracked gas streams or in refinery off-gases and are commonly associated with large quantities of hydrogen. These gases generally comprise methane, carbon monoxide, carbon dioxide, acetylene, ethane, methyl acetylene, propadiene, propylene, propane, butadienes, butenes, butanes, $C_5$'s, $C_6$–$C_8$ non-aromatics, benzene, toluene, xylenes, ethyl benzene, styrene, $C_9$-400° F. gasoline, 400+° F. fuel oil and water.

Numerous processes are known in the solvent absorption art for isolation and recovery of olefins from cracked, refinery, and synthetic gases containing these unsaturated compounds. Some processes utilize specific paraffinic compounds as an absorption oil, and others utilize an aromatic absorption oil as a solvent within an absorber column or an absorber-stripper column having a reboiler.

Thermal cracking of hydrocarbon feedstocks in pyrolysis furnaces for production of ethylene has been an established technology since the 1940's. The pyrolysis furnace gases were sent to the recovery section of an ethylene plant in which the first fractionation column was a front-end demethanizer operating at about −150° C. The deacidified, compressed, dried, and chilled pyrolysis gases were fed to the demethanizer after five compression stages to 500 psia. The demethanizer bottoms were fed to a deethanizer, and the demethanizer overhead, rich in hydrogen, was fed to a cryogenic unit which recovered additional ethylene from the fuel gas stream. A back-end acetylene removal system, such as a series of two acetylene reactors, was typically located between the deethanizer and the C2 splitter or between the depropanizer and the C3 splitter. This arrangement caused the production of large amounts of green oil, a polymer formed from olefins and diolefins, which was likely to freeze in the C2 splitter or accumulate in the ethane vaporizer.

In 1971, G. M. Clancy and R. W. Townsend proposed a heat pumped depropanizer in "Ethylene Plant Fractionation", *Chemical Engineering Progress,* Vol. 67, No. 2, Pages 41–44, as the front end distillation column for receiving the compressed gas from the fourth compression stage after passage through a single catalytic acetylene hydrogenation reactor having no need for regeneration because of the high partial pressure of hydrogen in the gases being treated. This reactor sequence produced no green oil, provided stable flow rates at all plant throughputs, eliminated fouling in the high-pressure stage of the cracked gas compressor, eliminated polymerization of butadiene in the deethanizer and its reboiler, enabled ethylene and propylene purity specifications to be met more easily, simplified operation and maintenance, and reduced capital, horsepower, and operating costs for the plant.

W. K. Lam and L. Lloyd discussed a theory for selective acetylene hydrogenation in "Catalyst Aids Selective Hydrogenation of Acetylene", *The Oil and Gas Journal,* Mar. 27, 1972, pages 66–70. They explained that the catalyst contains 0.04% palladium impregnated on its alpha-alumina support which is calcined so that the surface area and pore volume lie within carefully controlled limits.

W. K. Lam and A. J. Weisenfelder discussed capital and operating costs in "Low-Capital Ethylene Plants", as presented at the AIChE Spring National Meeting, Apr. 6–10, 1986 in New Orleans, La., for a fractionation sequence of deethanizer - demethanizer - C2 splitter, in which the gross deethanizer overhead, containing the C2 and lighter fraction of the cracked gas, was compressed in the last stage of the cracked -gas compressor and then fed to a selective, front-end, catalytic hydrogenation reactor.

In a paper presented at the Petrochemicals Session at PACHEC '88, Oct. 19–21, 1988, entitled "Theory and Reaction Mechanism for Commercial Selective Catalytic Hydrogenation Reactors", W. K. Lam discussed acetylene removal processes in ethylene plants, characterizing them as divided into four types:

1. solvent absorption of acetylene, which was used in the early 1950's;
2. cracked gas train hydrogenation reactors, available in the late 1950's;
3. back-end catalytic hydrogenation reactors, available in the early 1960's and now commonly used; and
4. front-end selective catalytic hydrogenation reactors.

Lam analyzed reaction rates and postulated a theory for selective hydrogenation of acetylene involving the displacement and/or exclusion of ethylene from active sites of the palladium catalyst by selectivity moderators, such as propadiene, methyl acetylene, and carbon monoxide, in order of increasing reactivity.

At the AIChE Ethylene Producers' Conference, March 19, 1990, W. K. Lam, S. C. K. Cua, and K. F. McNulty discussed reaction theory in terms of a kinetic and dynamic model for the front-end acetylene hydrogenation reactor that accurately predicted its operation during changing operating conditions.

U.S. Pat. No. 3,691,251 proposed the use of a lower cost desiccant, such as an activated alumina, for the top two-three feet of the molecular sieve bed in a downflow drying operation for a cracked propane stream containing ethylene and other unsaturated constituents, e.g., dienes which deposit or form polymers or otherwise plug a desiccant, such as a molecular sieve, causing maldistribution of the cracked gases and inadequate drying.

In U.S. Pat. No. 4,345,105, methyl acetylene and propadiene are removed from a stream by hydrogenation in order to minimize any danger of violent decomposition or explosion or coke formation.

U.S. Pat. No. 4,540,422 points out that in the fractionation to separate propylene from propane in a stream that has been recovered from de-ethanized and de-butanized gas cracking product, the concentration of methylacetylene and propadiene in the bottoms from the fractionation increases proportionally as the concentration of propane in the feedstock decreases. Particularly when the propane stream is recycled to the gas cracking operation, the high content of acetylenes is potentially explosively hazardous.

This ethylene recovery process, utilizing a heat pumped depropanizer in combination with a front-end selective catalytic hydrogenation reactor for acetylene removal, has been a very useful advance in the art, but it is nevertheless characterized by high energy costs so that there is a real need for modifications that conserve energy.

In U.S. Pat. No. 4,743,282, Y. R. Mehra disclosed the replacement of the low-temperature fractionation train of an olefin producing facility with an extractive stripping column employing a preferential physical solvent which is selective for ethylene and heavier hydrocarbons. Simulated performance showed that solvent losses and product purity were significantly better than prior art absorption processes of ethylene recovery.

In U.S. Pat. No. 4,832,718, Y. R. Mehra disclosed a process for contacting an olefins-containing gas stream at no more than 500 psia with regenerated solvent to produce an off-gas stream of hydrogen and methane and an ethylene-plus product stream while avoiding operation near the system critical pressure as evidenced by the difference between liquid and vapor density being less than 20 pounds per cubic foot. Paraffinic and naphthenic solvents of a specified range of molecular weights and UOP characterization factors, in addition to benzene and toluene, were disclosed as satisfactory solvents.

In U.S. Pat. No. 5,019,143, Y. R. Mehra described a continuous process for contacting an olefins-containing feed gas stream in a demethanizing-absorber column, having at least one reboiler, with a specified lean physical solvent stream to produce a rich solvent bottoms stream containing ethylene and heavier hydrocarbons and an overhead stream containing the remaining lighter components of the feed gas, then regenerating the rich solvent stream in a distillation column, having at least one reflux condenser and at least one reboiler, to produce the ethylene plus hydrocarbon product as an overhead stream, without further need for demethanizing the ethylene plus product by cryogenic fractionation, and the lean physical solvent as a bottoms stream for recycling to the contacting step. This process, illustrated in FIGS. 8 and 9, was suitable for all hydrocarbon gas streams containing at least 5 mol % of ethylene. In the cryogenic demethanization sequence, after feedstock cracking and water washing, the cracked gas is compressed, dried, and subcooled to −150° F. (−101° C.) and lower to condense out hydrocarbons prior to demethanization. Because methane is a light gas and has a very low boiling point, it must be distilled under pressure and condensed at about −142° F. (−97° C.) with ethylene refrigerant. At this and other low temperatures in the process, ordinary carbon steel becomes quite brittle. More expensive nickel-bearing steel must be used to fabricate the distillation column and associated equipment.

An important factor for ethylene plant design during the 1990's is that most of the recent pyrolysis furnaces being built or commissioned are of the very low residence time design (0.1 to 0.2 second) which produces high yields of ethylene but increases acetylene production two to three times over that of the higher residence time crackers of the early 1980's, so that back-end acetylene reactor systems have had many operational problems, such as high temperature rise across the back-end reactor, hydrogenation of large amounts of ethylene due to non-selectivity, and high production of green oil. Another factor is that the specification of acetylene in ethylene product is now commonly set at 1 ppmv or less.

In contrast, the front-end heat-pump deethanizer and depropanizer process sequences have many advantages, especially when used with a front-end selective catalytic hydrogenation acetylene reactor system. Such a front-end reactor provides cooler effluent because the gases are greatly diluted by the presence of hydrogen and methane. The front-end reactor also enables the hydrogen in the process stream to be used for hydrogenation, minimizes catalyst fouling so that frequent on-site catalyst regeneration is not required, eliminates green oil production, and provides ethylene and propylene gain across the reactor so that production from the plant is significantly increased because acetylene is selectively hydrogenated to ethylene and around 80% of the methyl acetylene (MA) and 20% of the propadiene (PD) are selectively converted to propylene. The front end hydrogenation step consequently reduces the amount of methyl acetylene and propadiene to be hydrogenated in the tail-end MAPD reactor. In addition, the combination of the front-end reactor and the depropanizer or deethanizer as the front-end column provides greater stability and flexibility for the operation of an ethylene plant, so that it may be employed over a range of feedstocks from ethane and propane to atmospheric gas oil, and the system is less subject to disturbances due to turndown or composition changes resulting from the cyclical operation of the pyrolysis furnaces. Certain process operations and/or equipment items normally required in a conventional front-end demethanizer ethylene plant are also eliminated, comprising:

a) the liquid-phase primary cracked gas drier;
b) regeneration facilities including a furnace for the back-end acetylene reactors;
c) green oil removal facilities;
d) the propylene product drier; and
e) the high pressure condensate stripper.

It is characteristic of all conventional ethylene recovery plants, whether the front-end column provides demethanization, deethanization, or depropanization, that a refrigeration system is required for separation of methane and ethylene. The required cryogenic temperatures for such a refrigeration system necessitate use of 3½% nickel in all drums and heat exchangers and stainless steel in all piping and thereby increase the total plant installed cost.

By utilizing an absorber-stripper column to treat the vapor from the condenser of the depropanizer column, Mehra has shown that the following process operations and/or equipment items can be eliminated, thereby saving significant capital and operating costs for the plant:

a) the ethylene compressor, the ethylene condenser, and cascading operation of the ethylene-propylene refrigeration system, thereby greatly reducing maintenance costs and contributing significantly to the ease of start-up and on-going operations;

b) the high-pressure stripper in the compression train;

c) the conventional low temperature demethanizer feed chilling train, enabling replacement of the multitude of cold exchangers together with their associated low temperature piping by fewer exchangers using killed carbon steel; and d) the methane compressor, if low-pressure demethanization is involved in conventional front-end demethanizer design.

However, it has been realized that the presence of acetylenes, diolefins, and butadienes, in particular, presents a potential for fouling equipment associated with the hot portions of the solvent regeneration system. Consequently, there exists an immediate need to provide means to significantly reduce the concentration of acetylenes and diolefins in the feed to the absorber-stripper configuration proposed by Mehra. For the absorption-based Mehra system, there also continues to be a real need to cost effectively reduce the solvent losses. Moreover, the Mehra process has been troubled by the typical asymptotic relationship of solvent circulation rates to completeness of ethylene recovery, so that there exists an additional need for a more energy effective method for ethylene recovery.

SUMMARY OF THE INVENTION

It is accordingly an object of this invention to provide a means for reducing the concentration of acetylenes and diolefins in the feed gas to an absorber-stripper column, hereinafter identified as an absorber having intercooling and reboiling.

It is an additional object to provide a method for reducing the energy costs of recovering solvent from the absorber.

It is further an object to provide a method for reducing the costs of ethylene recovery while utilizing an absorber.

In accordance with the principles of this invention, it has been discovered that by processing overhead gases from a heat-pumped deethanizer or depropanizer, which is coupled with a front-end catalytic acetylene hydrogenation reactor, in an absorber-stripper configuration capable of recovering 75% to 95% of contained ethylene from the reactor effluent gases and subsequently processing the overhead gases from the absorber-stripper column to recover the combined solvent and remaining 5% to 25% of ethylene in a auto refrigerated recovery unit, all of the desired objectives of this invention are realized.

The process of this invention can be applied to all feedstocks for any conventional ethylene plant having a front-end deethanizer or a front-end depropanizer, but as described hereinafter, it is exemplified by using a full range naphtha feedstock for a plant with a front-end depropanizer.

The naphtha feedstock is vaporized and sent to the pyrolysis furnaces, and the furnace effluent is indirectly quenched in transfer-line exchangers before direct quench in the oil quench tower. Fuel oil fractions are produced from the quench system. Heat recovery from the hot furnace effluent is accomplished in the oil quench system by heat exchange with other process loads and generation of dilution steam.

The oil quench tower overhead is cooled further in the water quench system where the dilution steam is condensed. Heat is recovered from the circulating quench water by heat exchange with other process loads, especially the regeneration column feed preheater, so that there is an energy synergism within the overall system.

The cooled water quench tower overhead is compressed in three stages to an optimum pressure primarily governed by the operating pressure of the front-end depropanizer. At the cracked gas compressor third stage discharge, acid gases are removed by a combination of amine and/or caustic systems. The acid gas-free cracked gas is then dried before entering the fractionation section of the plant.

A low-pressure debutanizing stripper is located in the compression train to remove C5 and heavier fractions from the cracked gas. No high-pressure stripper is required in the compression train.

The process of this invention utilizes a front-end heat pumped depropanizer system coupled with a front-end selective catalytic acetylene hydrogenation reactor system. The front-end heat pumped depropanizer permits fractionation at low pressure and condensation at high pressure. Fouling is minimized when the depropanizer is operated at low pressure.

The energy for heat pumping of the depropanizer is provided by the fourth stage of the cracked gas compressor. At the compressor discharge, acetylene is selectively hydrogenated to ethylene in the front-end reactor system. In addition, heavier $C_3$ and $C_4$ acetylenes and diolefins contained in the depropanizer overhead are selectively hydrogenated to their respective olefins, resulting in overall olefin gains across the reactor system. No green oil is formed across this reactor system.

The acetylene-free C3-and-lighter portion of the cracked gas leaves the reactor and is dried in a dehydrator to remove trace quantities of moisture. This C3-and-lighter fraction leaves the depropanizer reflux drum and enters the solvent extraction system for recovery of C2-plus hydrocarbons.

The C3-and-lighter fraction is fed to the absorber column. The C2's and C3's are absorbed by the solvent while methane and lighter components, together with some ethylene, leave the top of the absorber. This overhead stream is fed to a small auto refrigerated recovery unit where essentially all the C2's are recovered. Additionally, any solvent present in the absorber overhead is recovered cryogenically prior to absorber overhead gases entering the demethanizer column and is returned to the absorber. The demethanizer is auto refrigerated by means of turbo expanders. No external refrigeration is required for the auto refrigerated recovery unit.

The rich solvent from the bottom of the absorber is fed to a solvent regenerator where the demethanized C2's and C3's are recovered as overhead product. The lean solvent is returned to the absorber after heat recovery.

The C2's and C3's are further separated in a conventional deethanizer to produce a C2 and a C3 fraction. These two fractions are then processed in their respective super-fractionators to produce polymer grade ethylene and propylene products. Ethane and propane leaving their respective superfractionators (i.e., $C_2$ and $C_3$ splitters) as bottom products are recycled and cracked to extinction in the pyrolysis furnaces. Back-end acetylene hydrogenation reactors are eliminated.

The C4-plus fraction leaving the bottom of the heat pumped depropanizer is fed to a conventional debutanizer to produce a C4 mix as overhead product. The bottom product from the debutanizer is combined with the bottoms from the low pressure stripper in the compression train and sent to the pyrolysis gasoline hydrotreater.

External refrigeration for the ethylene recovery process of this invention is supplied only by a propylene refrigeration compressor. No ethylene refrigeration is required by the ethylene recovery process of this invention.

Any solvent that is useful for absorbing hydrocarbons is suitable as the absorbent in the intercooled and reboiled demethanizing absorber of this invention. Such solvents include, but are not limited to, any of the solvents identified in earlier Mehra patents for use in all embodiments of the Mehra process.

The process of this invention is equally as useful for treating refinery off-gases as it is for treating cracked gases because its versatility enables it to be readily adapted to the great variety of such refinery off-gases.

BRIEF DESCRIPTION OF THE DRAWING

The FIGURE is a schematic flow diagram of the process of this invention in which a demethanizing absorber receives gases from a heat pumped depropanizer and sends its overhead to a small auto refrigerated recovery unit which obviates essentially all losses of olefins and solvent.

DESCRIPTION OF THE PREFERRED EMBODIMENT

With reference to the FIGURE, it should be understood that pipelines are in fact being designated when streams are identified hereinafter and that streams are intended, if not stated, when materials are mentioned. Moreover, flow-control valves, temperature regulatory devices, pumps, and the like are to be understood as installed and operating in conventional relationships to the major items of equipment which are shown in the drawings and discussed hereinafter with reference to the continuously operating process of this invention. All of these valves, devices, and pumps, as well as heat exchangers, accumulator, condensers, and the like, are included in the term, "auxiliary equipment". The term, "absorber", is conventionally employed for a gas/solvent absorbing facility, but when it is utilized in the process of this invention with a preferential physical solvent, it is considered to be an "extractor".

The process shown schematically in the flow sheet of the FIGURE comprises a heat pumped depropanizer 13, acetylene reactor 18, dehydrator 21, chilling and phase separation system 25, intercooled and reboiled demethanizing absorber 29, auto refrigerated recovery unit 35, solvent regenerator 53, deethanizer 41, and C2 splitter 47.

Cracked inlet gas stream 11, which is dry and free of CO2 and sulfur-containing gases, is cooled and fed to depropanizer 13 which has a reboiler. Its reacted overhead stream 19 is fed to dehydrator 21, producing dried stream 23 which is fed to system 25. Liquid stream 26 is recycled to depropanizer 13. Gas stream 27 is fed to absorber 29.

Absorber 29 produces overhead stream 31, which is fed to auto refrigerated recovery unit 35, and bottom stream 33, which is fed to regenerator 53. Auto refrigerated recovery unit 35 which produces a recovered solvent stream 32, which is recycled to absorber 29, and overhead stream 37, which leaves the plant as fuel gas.

Regenerator 53 produces lean solvent bottom stream 57, which is fed to the top of absorber 29, and overhead stream 55, which is combined with demethanizer bottoms stream 39 and fed as stream 42 to deethanizer 41. Bottom stream 45 from deethanizer 41 is sent to a $C_3$ splitter, and overhead stream 43 from deethanizer 41 is fed to $C_2$ splitter 47 which produces ethylene product stream 49 as its overhead and ethane recycle stream 51 as its bottoms.

Utilizing an auto refrigerated recovery unit enables the process of this invention to avoid the high costs of maximizing solvent recovery and minimizing ethylene losses that have typically plagued absorption processes of the prior art, because with this invention process the demethanizing absorber may recover merely a major portion of the ethylene (75% to 95%) and then depend upon the auto refrigerated recovery unit to act as a scavenger for the remainder of the ethylene (5% to 25%) and any solvent accompanying it. This major portion of ethylene recovery through the absorber depends upon the specific plant economic situation, feedstock composition and costs, capital and operating cost factors, and the like.

As an example, the following table furnishes material balances in pound mols per hour for 24 components of 19 streams, as identified in the FIGURE, of the front-end depropanizing, front-end catalytic hydrogenation, and demethanizing absorption process of the invention for ethylene recovery from a cracked gas stream that is free of $CO_2$ and sulfur compounds and prepared by cracking a full range naphtha feedstock.

MATERIAL BALANCES FOR 24 COMPONENTS, IN POUND MOLES/HR, OF 19 STREAMS, AS IDENTIFIED IN THE FIGURE, OF FRONT-END HYDROGENATION AND ABSORPTION PROCESS FOR ETHYLENE RECOVERY

| Stream Nos. | 11 | 15 | 17 | 19 | 23 | 26 | 27 | 31 | 32 | 33 |
|---|---|---|---|---|---|---|---|---|---|---|
| Temperature, °F. | 50 | 118 | 159 | 225 | 225 | 10 | 10 | −29 | −74 | 119 |
| Pressure, Psia | 175 | 482 | 117 | 454 | 454 | 445 | 445 | 440 | 439 | 451 |
| Stream Components, LB-MOLES/HR | | | | | | | | | | |
| Water | 0.00 | 0.00 | 0.00 | trace | 0.00 | 0.00 | 0.00 | 0.00 | 0.00 | 0.00 |
| Hydrogen | 2,410.60 | 2,421.10 | 0.00 | 2,138.84 | 2,138.84 | 10.50 | 2,128.33 | 2,128.35 | 0.02 | 0.00 |
| Methane | 3,801.20 | 3,961.60 | 0.00 | 3,961.60 | 3,961.60 | 160.45 | 3,801.15 | 3,801.54 | 0.94 | 0.55 |
| CO | 65.10 | 66.26 | 0.00 | 66.26 | 66.26 | 1.16 | 65.10 | 65.10 | 0.00 | 0.00 |
| Acetylene | 137.80 | 137.80 | 0.00 | 0.00 | 0.00 | 0.00 | 0.00 | 0.00 | 0.00 | 0.00 |
| Ethylene | 4,613.40 | 5,361.03 | 0.00 | 5,429.93 | 5,429.93 | 747.89 | 4,682.04 | 530.88 | 1.04 | 4,152.25 |
| Ethane | 568.20 | 717.47 | 0.00 | 786.37 | 786.37 | 149.30 | 637.07 | 5.09 | 0.02 | 632.17 |
| M-Acetylene | 52.00 | 56.92 | 1.51 | 11.38 | 11.38 | 6.43 | 4.95 | 0.05 | 0.00 | 6.23 |
| Propadiene | 34.70 | 57.54 | 0.12 | 46.03 | 46.03 | 22.95 | 23.08 | 0.27 | 0.01 | 27.97 |
| Propylene | 1,139.60 | 2,005.68 | 0.13 | 2,062.73 | 2,062.73 | 866.16 | 1,196.56 | 12.46 | 0.24 | 1,334.70 |
| Propane | 21.50 | 39.24 | 0.01 | 39.24 | 39.24 | 17.75 | 21.49 | 0.26 | 0.01 | 25.05 |
| VinylAcetylene | 20.00 | 0.03 | 19.99 | 0.03 | 0.03 | 0.02 | 0.00 | 0.00 | 0.00 | 0.00 |
| 1,3-Butadiene | 336.96 | 20.58 | 317.76 | 2.06 | 2.06 | 1.48 | 0.58 | 0.01 | 0.00 | 0.92 |
| i-Butene | 63.14 | 28.66 | 54.74 | 28.66 | 28.66 | 20.30 | 8.37 | 0.08 | 0.01 | 13.15 |
| 1-Butene | 44.83 | 42.38 | 46.40 | 60.90 | 60.90 | 43.64 | 17.26 | 0.16 | 0.02 | 27.42 |
| tr2-Butene | 37.87 | 0.11 | 37.84 | 0.11 | 0.11 | 0.08 | 0.03 | 0.00 | 0.00 | 0.05 |
| n-Butane | 39.00 | 2.68 | 38.15 | 2.68 | 2.68 | 1.86 | 0.82 | 0.01 | 0.00 | 1.39 |
| 13-CC5== | 48.20 | 0.00 | 48.20 | 0.00 | 0.00 | 0.00 | 0.00 | 0.00 | 0.00 | 0.00 |

-continued

| | | | | | | | | | | |
|---|---|---|---|---|---|---|---|---|---|---|
| 2M-1-butene | 58.44 | 0.00 | 58.44 | 0.00 | 0.00 | 0.00 | 0.00 | 0.00 | 0.00 | 0.00 |
| Benzene | 13.20 | 0.00 | 13.20 | 0.00 | 0.00 | 0.00 | 0.00 | 0.00 | 0.00 | 0.00 |
| 2M-2-pentene | 0.13 | 0.00 | 0.13 | 0.00 | 0.00 | 0.00 | 0.00 | 0.00 | 0.00 | 0.00 |
| n-Hexane | 0.00 | 0.00 | 0.00 | 0.00 | 0.00 | 0.00 | 0.00 | 3.01 | 2.61 | 5,721.53 |
| Styrene | 0.70 | 0.00 | 0.70 | 0.00 | 0.00 | 0.00 | 0.00 | 0.00 | 0.00 | 0.00 |
| m-Xylene | 0.60 | 0.00 | 0.60 | 0.00 | 0.00 | 0.00 | 0.00 | 0.00 | 0.00 | 0.00 |
| Total Lb-moles/hr | 13,507.17 | 14,919.10 | 637.93 | 14,636.83 | 14,636.83 | 2,050.00 | 12,586.82 | 6,547.26 | 4.92 | 11,943.39 |
| Total Lbs/hr | 308,321 | 341,831 | 36,779 | 341,831 | 341,831 | 70,289 | 271,542 | 82,970 | 282 | 689,623 |

| Stream Nos. | 37 | 39 | 42 | 43 | 45 | 49 | 51 | 55 | 57 |
|---|---|---|---|---|---|---|---|---|---|
| Temperature, °F. | 85 | −20 | 21 | −28 | 108 | −35 | 6 | 25 | −56 |
| Pressure, Psia | 70 | 272 | 245 | 240 | 247 | 231 | 244 | 245 | 473 |
| Stream Components, LB-MOLES/HR | | | | | | | | | |
| Water | 0.00 | 0.00 | 0.00 | 0.00 | 0.00 | 0.00 | 0.00 | 0.00 | 0.00 |
| Hydrogen | 2,128.33 | 0.00 | 0.00 | 0.00 | 0.00 | 0.00 | 0.00 | 0.00 | 0.00 |
| Methane | 3,800.29 | 0.35 | 0.90 | 0.90 | 0.00 | 0.90 | 0.00 | 0.55 | 0.00 |
| CO | 65.10 | 0.00 | 0.00 | 0.00 | 0.00 | 0.00 | 0.00 | 0.00 | 0.00 |
| Acetylene | 0.00 | 0.00 | 0.00 | 0.00 | 0.00 | 0.00 | 0.00 | 0.00 | 0.00 |
| Ethylene | 9.32 | 520.37 | 4,672.56 | 4,672.52 | 0.04 | 4,664.65 | 7.87 | 4,152.19 | 0.06 |
| Ethane | 0.01 | 5.07 | 637.06 | 636.62 | 0.44 | 1.18 | 635.44 | 632.00 | 0.18 |
| M-Acetylene | 0.00 | 0.04 | 4.95 | 0.00 | 4.95 | 0.00 | 0.00 | 4.91 | 1.32 |
| Propadiene | 0.00 | 0.26 | 23.08 | 0.00 | 23.08 | 0.00 | 0.00 | 22.82 | 5.15 |
| Propylene | 0.00 | 12.23 | 1,196.58 | 0.99 | 1,195.59 | 0.00 | 0.99 | 1,184.35 | 150.34 |
| Propane | 0.00 | 0.25 | 21.49 | 0.00 | 21.49 | 0.00 | 0.00 | 21.24 | 3.81 |
| VinylAcetylene | 0.00 | 0.00 | 0.00 | 0.00 | 0.00 | 0.00 | 0.00 | 0.00 | 0.00 |
| 1,3-Butadiene | 0.00 | 0.00 | 0.58 | 0.00 | 0.58 | 0.00 | 0.00 | 0.57 | 0.35 |
| i-Butene | 0.00 | 0.07 | 8.35 | 0.00 | 8.35 | 0.00 | 0.00 | 8.28 | 4.87 |
| 1-Butene | 0.00 | 0.14 | 17.21 | 0.00 | 17.21 | 0.00 | 0.00 | 17.07 | 10.34 |
| tr2-Butene | 0.00 | 0.00 | 0.03 | 0.00 | 0.03 | 0.00 | 0.00 | 0.03 | 0.02 |
| n-Butane | 0.00 | 0.01 | 0.81 | 0.00 | 0.81 | 0.00 | 0.00 | 0.81 | 0.59 |
| 13-CC5= = | 0.00 | 0.00 | 0.00 | 0.00 | 0.00 | 0.00 | 0.00 | 0.00 | 0.00 |
| 2M-1-butene | 0.00 | 0.00 | 0.00 | 0.00 | 0.00 | 0.00 | 0.00 | 0.00 | 0.00 |
| Benzene | 0.00 | 0.00 | 0.00 | 0.00 | 0.00 | 0.00 | 0.00 | 0.00 | 0.00 |
| 2M-2-pentene | 0.00 | 0.00 | 0.00 | 0.00 | 0.00 | 0.00 | 0.00 | 0.00 | 0.00 |
| n-Hexane | 0.00 | 0.40 | 0.50 | 0.00 | 0.50 | 0.00 | 0.00 | 0.10 | 5,721.82 |
| Styrene | 0.00 | 0.00 | 0.00 | 0.00 | 0.00 | 0.00 | 0.00 | 0.00 | 0.00 |
| m-Xylene | 0.00 | 0.00 | 0.00 | 0.00 | 0.00 | 0.00 | 0.00 | 0.00 | 0.00 |
| Total Lb-moles/hr | 6,003.05 | 539.18 | 6,584.09 | 5,311.04 | 1,273.06 | 4,666.73 | 644.30 | 6,044.91 | 5,898.87 |
| Total Lbs/hr | 67,344 | 15,340 | 204,234 | 150,281 | 53,953 | 130,911 | 19,370 | 188,894 | 500,764 |

These 19 process streams are associated with depropanizer 13, acetylene reactor 19, dehydrator 21, chilling and phase separation 25, demethanizing absorber 29, auto refrigerated recovery unit 35, deethanizer 41, $C_2$ splitter 47, and solvent regenerator 53.

Inspection of the table reveals that depropanizer 13 removes in stream 17 most of the $C_{4+}$ compounds received from streams 11 and 26. Acetylene reactor 18 removes all of the acetylene, reduces the amount of propadiene, removes most of the butadiene, and increases the amounts of ethylene, ethane, propylene, and 1-butene. Because of this ethylene production and the very slight losses of ethylene in the fuel gas that is achieved by the process of this invention, the quantity of ethylene product is greater than the quantity of ethylene in the incoming feedstock.

This reactivity of reactor 18 is highly significant because propadiene and particularly butadiene tend to polymerize within and clog demethanizing absorber 29. As shown in the table, reactor 18 reduces the amount of 1,3-butadiene from 20.58 pound moles per hour to 2.06 pound moles per hour, a reduction achieved by the sequential arrangement of reactor 18 and demethanizing absorber 29 that accomplishes the first objective of this invention.

Returning to a review of the accomplishments of the invention as illustrated in the table for the example, dehydrator 21 removes any trace of water in stream 19 and essentially functions as insurance against the presence of moisture. In recycle stream 26, chilling and phase separation 25 removes 14% of the ethylene, 57% of the M-acetylene, 50% of the propadiene, 42% of the propylene, 72% of the vinylacetylene, 35% of the 1,3-butadiene, 71% of the i-butene, and 72% of the 1-butene that arrive in dehydrated stream 23. In rich solvent stream 33, absorber 29 removes 89% of the ethylene, 99% of the m-acetylene, 99% of the propylene, 99% of the 1,3-butadiene, 99% of the i-butene, and 99% of the 1-butene that arrives in streams 27, 32, and 57.

Such absorption results were achieved long ago in the prior art, but the overall process results were economically unbearable because of losses to the fuel gas stream. By passing this stream through auto refrigerated recovery unit 35, however, the process of this invention loses in fuel gas stream 37, as shown in the table, 1.76% of the incoming ethylene in stream 31 and 0.20% of the feedstock ethylene in stream 11 and nothing of any other component other than the fuel gases: hydrogen, methane, and carbon monoxide, while keeping the required circulation of solvent, n-hexane, to 42% of the total incoming feed gas on a weight basis. In stream 39, auto refrigerated recovery unit 35 removes 98.0% of the ethylene, 99.6% of the ethane, and 99.2% of the propylene arriving in stream 31, returning the remaining materials to absorber 29 in stream 32.

Absorber 29 is thereby operable in a relaxed manner, instead of being stretched to its limit, and consequently requires a relatively small capital investment and low operating expenses. Auto refrigerated recover unit 35, receiving 48.5% of the incoming feed stream on a pound-mole basis and 26.9% thereof on a weight basis, according to the example as set forth in the table, and requiring no external cryogenic refrigeration for condensation of compounds in its bottoms stream (5.0% by weight of the incoming feedstock in this example), consequently also requires relatively little capital investment and surprisingly low operating expenses.

Because it will be readily apparent to those skilled in the art of treating refinery off-gases and cracked hydrocarbon gases containing olefins that innumerable variations, modifications, applications, and extensions of the example and principles hereinbefore set forth can be made without departing from the spirit and the scope of the invention, that is hereby defined as such scope and is desired to be protected should be measured, and the invention should be limited, only by the following claims.

What is claimed is:

1. A process for recovering ethylene from a stream of feedstock gases selected from the group consisting of cracked hydrocarbon gases and refinery off-gases, comprising removing at least 75% of said ethylene in a solvent-based, demethanizing absorber, prior to an auto refrigerated recovery unit which recovers the remainder of said ethylene from said feedstock gases.

2. The process of claim 1, wherein said demethanizing absorber removes 75–95% of said ethylene from said feedstock gases.

3. The process of claim 1, wherein said absorber is preceded by a selective catalytic hydrogenation reactor which substantially reduces acetylenes and diolefins in said gases.

4. The process of claim 3, wherein said reactor is preceded by a front-end depropanizer which receives said feedstock gases and removes $C_{4+}$ hydrocarbons therefrom.

5. The process of claim 4, wherein chilling and phase separation is interposed between said reactor and said absorber, producing a liquid stream which is recycled t said depropanizer.

6. A process for recovering ethylene from a cooled, sweetened, and compressed hydrocarbon gas stream containing hydrogen, methane, carbon monoxide, ethane, ethylene, acetylene, and $C_3$ and heavier hydrocarbons characteristic of ethylene plant cracked gas and/or a refinery off gas stream, said process comprising:

A. feeding said hydrocarbon gas stream to a heat-pumped depropanizer and producing therefrom a bottom stream of $C_{4+}$ hydrocarbons and an overhead stream of $C_3$ and lighter hydrocarbons;

B. feeding said overhead stream to a selective hydrogenation reactor to produce a reactor effluent stream containing reduced amounts of acetylene and diolefins;

C. feeding said reactor effluent stream to a dehydrator to remove trace quantities of water formed in the reactor;

D. feeding the dried reactor effluent stream produced by said Step C through at least one cooler and separating said stream into a vapor stream and a liquid stream that is recycled to said depropanizer;

E. feeding said vapor stream to an intercooled and reboiled demethanizing absorber and producing therefrom a bottom stream of rich solvent containing most of said ethylene and heavier hydrocarbons present in said vapor stream and an overhead stream containing said hydrogen, said methane, said carbon monoxide, and the remainder of said ethylene and heavier hydrocarbons;

F. feeding said overhead stream to a auto refrigerated recovery unit which is cryogenically cooled and producing therefrom an overhead stream of hydrogen, methane, and carbon monoxide having less than 0.5% of said ethylene and a bottom stream containing substantially all of the remainder of the said ethylene and heavier hydrocarbons;

G. feeding said rich solvent of Step E to a solvent regenerator and obtaining therefrom a bottom stream of lean solvent which is recycled to the top of said demethanizing absorber and an overhead hydrocarbon stream of said ethylene and heavier hydrocarbons;

H. combining said overhead hydrocarbon stream of step G with said bottom stream from said auto refrigerated recovery unit of step F and feeding said combined stream to a deethanizer which produces a bottom stream of propylene and heavier hydrocarbons and an overhead stream of ethylene and ethane; and I. feeding said overhead stream of said ethylene and ethane to a C2 splitter and producing therefrom a bottom stream of ethane and an overhead stream of ethylene as product.

7. The process of claim 6, wherein said bottom stream of propylene and heavier hydrocarbons from said deethanizer is fed to a C3 splitter which produces propylene and propane.

8. The process of claim 7, wherein said hydrocarbon gas feed stream is a cracked gas stream, and said ethane and said propane are recycled for cracking.

9. A process of claim 6, wherein said hydrocarbon gas feed stream is a refinery off-gas stream, and said ethane and propane are used as fuel.

10. The process of claim 6, wherein said hydrocarbon gas feed stream is a refinery off-gas stream, and said ethane and propane are disposed of as products.

11. The process of claim 6, wherein said hydrocarbon gas feed stream is a cracked gas stream and said ethane and propane are used as fuel.

12. The process of claim 6, wherein said hydrocarbon gas feed stream is a cracked gas stream and said ethane and propane are disposed of as products.

13. A process for recovering ethylene from a cracked, cooled, sweetened and compressed hydrocarbon gas stream containing hydrogen, methane, carbon monoxide, ethylene, ethane, acetylene, and $C_3$ and heavier hydrocarbons characteristic of an ethylene plant cracked gas and/or a refinery off gas stream which comprises:

A. feeding said hydrocarbon gas stream to a deethanizer fractionation column and producing therefrom a bottom stream of $C_3+$ hydrocarbons and an overhead stream of $C_2$ and lighter hydrocarbons plus a small fraction of $C_3$ hydrocarbons;

B passing said overhead stream through a compressor to produce a compressed overhead stream;

C. passing said compressed overhead stream through a cooler and/or heater to achieve the required inlet condition for said selective hydrogenation reactor to produce a reactor effluent stream containing reduced amounts of acetylenes and diolefins;

D. passing said reactor effluent stream through a drier to remove trace quantities of water formed in the reactor;

E. passing said dried reactor effluent stream through at least one cooler and separating said effluent stream into a liquid stream that is recycled to said deethanizer column and a vapor stream;

F. feeding said vapor stream to an intercooled and reboiled demethanizing absorber and producing therefrom a bottom stream of rich solvent containing most of said ethylene and heavier hydrocarbons present in said vapor stream and an overhead stream containing said hydrogen, said methane, said carbon monoxide, and some $C_2$ and heavier hydrocarbons;

G. feeding said overhead stream of Step F to an auto refrigerated recovery unit which is cryogenically cooled and producing therefrom an overhead stream of hydrogen, methane, and carbon monoxide having less than 0.5% of said ethylene and a bottom stream containing substantially all of the remainder of said ethylene and heavier hydrocarbons;

H. feeding said rich solvent to a solvent regenerating column and obtaining therefrom a bottom stream of lean solvent which is recycled to the top of said demethanizing absorber column and an overhead hydrocarbon stream of said ethylene and heavier hydrocarbons; and I. combining said overhead hydrocarbon stream of Step H with said bottom stream of Step G and feeding said combined stream to a $C_2$ splitter column and producing therefrom a bottom stream of ethane and an overhead stream of ethylene as product.

14. The process of claim 9, wherein said hydrocarbon gas feed stream is a cracked gas stream and said ethane is recycled for cracking.

15. The process of claim 13, wherein said hydrocarbon gas feed stream is a refinery off-gas stream and said ethane and propane are used as fuel.

16. The process of claim 13, wherein said hydrocarbon gas feed stream is a refinery off-gas stream and said ethane and propane are disposed of as products.

17. In a process for recovery of olefins from hydrocarbon gases containing olefins by a demethanizing absorber with a preferential physical solvent, the improvement comprising:

A. pretreating said olefin-containing gases through a heat-pumped front-end deethanizer or a heat-pumped front-end depropanizer;

B. subsequently compressing an overhead stream from said deethanizer or said depropanizer; and C. selectively catalytically hydrogenating said compressed gases to significantly reduce the acetylene and diolefins content thereof before feeding said gases to said demethanizing absorber.

18. In a process for producing ethylene from a gas stream selected from the group consisting of refinery off-gases and cracked hydrocarbon gases containing ethylene, the improvement comprising sequentially feeding respective overhead streams from a front-end heat-pumped depropanizer to a selective front-end catalytic acetylene hydrogenation reactor, from said reactor to a dehydrator, from said dehydrator to a chilling and phase separation unit which produces a reflux stream, from said chilling and phase separation unit to an intercooled and reboiled demethanizing absorber which produces a rich solvent bottom stream containing 75% to 95% of said ethylene, and from said absorber to an auto refrigerated recovery unit that produces an overhead fuel gas stream, containing no more than about 0.5% of the ethylene in said overhead stream from said chilling and phase separation unit to said demethanizing absorber, and a bottom stream that contains the remaining 5% to 25% of said ethylene, said bottom stream being combined with an overhead stream from a solvent regenerator, to which is fed said rich solvent bottom stream from said demethanizing absorber, to form a demethanized ethylene stream that is fed to a deethanizer which produces an overhead stream for feeding to a $C_2$ splitter column that produces ethylene product.

19. A process that: (a) provides a means for reducing the concentration of acetylenes and diolefins in a feed gas stream to an absorber having intercooling and reboiling, (b) reduces the costs of recovering solvent from an overhead stream produced by said absorber, and (c) reduces the costs of ethylene recovery while utilizing said absorber, said process comprising:

A. treating a gas stream, selected from the group consisting of refinery off-gases and cracked hydrocarbon gases containing ethylene, in a heat-pumped deethanizer or depropanizer and coupling said deethanizer or depropanizer with a front-end catalytic acetylene hydrogenation reactor which produces an overhead effluent gas stream as said feed gas stream to said absorber;

B. feeding said overhead effluent gas stream from said reactor to said absorber which produces a bottom stream of rich solvent, containing 75% to 95% of the ethylene in said overhead effluent gas stream, and an overhead gas stream containing the remaining 5% to 25% of said ethylene;

C. feeding said overhead gas stream from said absorber to an auto refrigerated recovery unit to produce an overhead fuel gas stream containing no more than 0.5% of said ethylene in said overhead effluent gas stream and a bottom stream containing said 5% to 25% of said ethylene;

D. feeding said bottom stream of Step B to a solvent regenerator to produce a bottom stream of lean solvent which is recycled to said absorber and an overhead stream which contains said 75% to 95% of said ethylene; and E. combining said bottom stream of Step C with said overhead stream of Step D to form an ethylene product stream.

20. The process of claim 19, wherein said auto refrigerated recovery unit requires no external cryogenic refrigeration for condensation of compounds in said bottom stream of Step C.

* * * * *